US012698066B1

(12) United States Patent
Geerts

(10) Patent No.: US 12,698,066 B1
(45) Date of Patent: Aug. 4, 2026

(54) SYSTEMS AND METHODS FOR PROVIDING NON-VISUAL FEEDBACK WHEN A MARINE PROPULSION DEVICE OF A MARINE VESSEL RETURNS TO CENTER

(71) Applicant: Brunswick Corporation, Mettawa, IL (US)

(72) Inventor: Peter J. Geerts, Germantown, WI (US)

(73) Assignee: Brunswick Corporation, Mettawa, IL (US)

( * ) Notice: Subject to any disclaimer, the term of this patent is extended or adjusted under 35 U.S.C. 154(b) by 62 days.

(21) Appl. No.: 18/774,389

(22) Filed: Jul. 16, 2024

(51) Int. Cl.
*B63B 49/00* (2006.01)
*B63H 25/02* (2006.01)

(52) U.S. Cl.
CPC ..... *B63B 49/00* (2013.01); *B63H 25/02* (2013.01); *B63H 2025/022* (2013.01)

(58) Field of Classification Search
CPC .. B63B 49/00; B63H 25/00; B63H 2025/005; B63H 25/02; B63H 2025/022; B63H 25/06; B63H 25/36
See application file for complete search history.

(56) References Cited

U.S. PATENT DOCUMENTS

| | | | | |
|---|---|---|---|---|
| 9,733,645 | B1 | 8/2017 | Andrasko | |
| 9,809,292 | B1 | 11/2017 | Gonring | |
| 10,196,122 | B1 | 2/2019 | Andrasko | |
| 10,370,078 | B2 * | 8/2019 | Morvillo | B63H 20/12 |
| 10,703,456 | B1 | 7/2020 | Andrasko | |
| 10,994,822 | B1 | 5/2021 | Derginer | |
| 11,091,243 | B1 * | 8/2021 | Gable | B63H 25/46 |
| 11,628,920 | B2 | 4/2023 | Karnick | |
| 2022/0306189 | A1 * | 9/2022 | Ojima | B62D 15/0295 |
| 2023/0286576 | A1 * | 9/2023 | Kuehner | B62D 15/0205 |

* cited by examiner

*Primary Examiner* — Brian Wilson
(74) *Attorney, Agent, or Firm* — Andrus Intellectual Property Law, LLP

(57) ABSTRACT

A system for providing non-visual feedback when a steerable component of a marine vessel returns to center is provided, the system comprising: a steerable component coupled to the marine vessel and configured to rotate about a steering axis to affect a direction of movement of the marine vessel; a steering input device; a feedback device coupled to the steering input device; and one or more hardware processors configured to: determine that a rotational position of the steerable component about the steering axis has reached a centered position; and in response to determining that the rotational position of the steerable component about the steering axis has reached the centered position, cause the feedback device to provide non-visual feedback via the steering input device.

28 Claims, 5 Drawing Sheets

SYSTEMS AND METHODS FOR PROVIDING NON-VISUAL FEEDBACK WHEN A MARINE PROPULSION DEVICE OF A MARINE VESSEL RETURNS TO CENTER

FIELD

The present disclosure generally relates to systems and methods for providing non-visual feedback when a marine propulsion device of a marine vessel returns to center.

BACKGROUND

The following U.S. Patents are incorporated herein by reference, in entirety:

U.S. Pat. No. 9,733,645 discloses a system for controlling handling of a marine vessel comprising a steerable component coupled to the marine vessel and steerable to a plurality of positions so as to vary a direction of movement of the marine vessel. A controller is communicatively connected to an actuator of the steerable component and a user input device provides to the controller an operator-initiated steering command to steer the steerable component to one of the plurality of positions. A sensor provides to the controller an indication of an undesired course change of the marine vessel. The controller has a vessel direction control section that outputs a command to the actuator to change a position of the steerable component from the one of the plurality of positions so as to automatically counteract the undesired course change. The vessel direction control section is active only when the operator-initiated steering command is less than or equal to a predetermined threshold.

U.S. Pat. No. 9,809,292 discloses a system for controlling steering alignment in the marine vessel includes a steering position sensor that senses a rotational position of a steering device and a component position sensor that senses a rotational position of a steerable component coupled to a marine vessel and steerable to a plurality of positions so as to vary the direction of movement of the marine vessel. The steering actuated is communicatively connected to the steering device and the steerable component to actuate steering of the marine vessel. A controller is communicatively connected the steering actuator. The controller compares the rotational position of the steering device to the rotational position of the steerable component and controls the steering actuator to adjust the operation between the steering device and the steerable component until alignment between the steering device and the steerable component is reached.

U.S. Pat. No. 10,196,122 discloses a steering system on a marine vessel includes a steerable component, a steering actuator that moves the steerable component about a steering axis, a steering wheel, a steering position sensor that senses a position of the steering wheel, and one or more control modules. The one or more control modules are configured to receive an initial component position of the steerable component and calculate an initial normalized steering value based on the initial component position. The initial wheel position of a manually rotatable steering wheel is received with respect to a zero position, and the initial normalized steering value is correlated to the initial wheel position. Subsequent wheel positions are received, and each subsequent wheel position is correlated to a normalized steering value based on a normalizing ratio and an offset until the steering wheel reaches an aligned position with the steerable component. The steering actuator is controlled based on the normalized steering value.

U.S. Pat. No. 10,703,456 discloses a drive-by-wire control system for steering a propulsion device on a marine vessel includes a steering wheel that is manually rotatable and a steering actuator that causes the propulsion device to steer based on rotation of the steering wheel. The system further includes a resistance device that applies a resistance force against rotation of the steering wheel, and a controller that controls the resistance device to vary the resistance force based on at least one sensed condition of the system.

U.S. Pat. No. 10,994,822 discloses a steering system on a marine vessel includes a steering wheel, a wheel sensor configured to measure wheel movement of the steering wheel, a steering actuator configured to rotate a steerable component based on movement of the steering wheel, and a variable resistance device controllable to apply a variable resistance amount to resist movement of the steering wheel. The system further comprises a controller that controls the variable resistance device and is configured to receive the wheel movement measurements by the wheel sensor and determine a resistance amount based on the wheel movement measurements and a corresponding steering response relative to the response capability of the steering system, and then to control the variable resistance device based on the resistance amount.

U.S. Pat. No. 11,628,920 discloses a steering system for a marine vessel includes a steerable marine drive rotatable about a steering axis to desired steering angles, a steering actuator configured to rotate the marine drive about the steering axis, a steering wheel manually rotatable by a user, and a wheel position sensor configured to sense a position of the steering wheel. The steering system further includes a user interface device configured to receive a user input to engage and disengage a quick steer mode and a control system configured to, in response to receiving a user input to engage a quick steer mode, employ a reduced steering ratio to translate positions of a steering wheel to desired steering angles of a marine drive. The control system is further configured to determine a vessel speed of the marine vessel and compare it to a threshold vessel speed. Upon the vessel speed exceeding the threshold vessel speed, the control system is configured to determine an output limit to prevent the marine vessel from further exceeding the threshold vessel speed while in the quick steer mode. The marine drive is automatically controlled based on the output limit and the steering actuator associated with the marine drive is controlled based on the reduced steering ratio.

SUMMARY

In accordance with some embodiments of the disclosed subject matter, a system for providing non-visual feedback when a steerable component of a marine vessel returns to center is provided, the system comprising: a steerable component coupled to the marine vessel and configured to rotate about a steering axis to affect a direction of movement of the marine vessel; a steering input device; a feedback device coupled to the steering input device; and one or more hardware processors configured to: determine that a rotational position of the steerable component about the steering axis has reached a centered position; and in response to determining that the rotational position of the steerable component about the steering axis has reached the centered position, cause the feedback device to provide non-visual feedback via the steering input device.

In accordance with some embodiments of the disclosed subject matter a system is provided, comprising: one or more hardware processors configured to: determine when a steerable component of a vehicle has returned to a centered position; and provide non-visual feedback to an operator of the vehicle upon the steerable component returning to the centered position, wherein the vehicle is optionally a marine vessel.

In some embodiments, the centered position corresponds to a rotational position at which the steerable component is aligned with a longitudinal axis of the marine vessel.

In some embodiments, the steerable component comprises a propulsion device that includes a power head, and the centered position is a rotational position at which the power head provides thrust that is directed substantially parallel to the longitudinal axis of the marine vessel.

In some embodiments, the steering input device comprises a steering wheel.

In some embodiments, the system further comprises: a steering actuator coupled to the steerable component, wherein the steering actuator is configured to cause the steerable component to rotate about the steering axis.

In some embodiments, the one or more hardware processors are further configured to: receive, from the steering actuator, a value indicative of the rotational position of the steerable component with respect to the centered position; and determine whether the rotational position of the steerable component about the steering axis has reached the centered position based on the value.

In some embodiments, the feedback device comprises a motor configured to provide haptic feedback, and the non-visual feedback includes haptic feedback provided via the steering input device.

In some embodiments, the feedback device comprises a variable resistance device configured to apply a variable resistance force to the steering input device that resists movement of the steering input device, and the non-visual feedback includes increased resistance to steering inputs provided via the steering input device.

In some embodiments, the one or more hardware processors are further configured to: determine whether the rotational position of the steerable component is within a predetermined range of the centered position; and in response to determining that the rotational position of the steerable component is within a predetermined range of the centered position, determine that the steerable component has reached the centered position.

In some embodiments, the one or more hardware processors are further configured to: adjusting a characteristic of the non-visual feedback as the rotational position moves closer to the centered position from a rotational position at a predetermined range from the centered position.

In some embodiments, the one or more hardware processors are further configured to: determine that the rotational position of the steerable component is within a predetermined range of the centered position; and in response to determining that the rotational position of the steerable component is within the predetermined range of the centered position, provide a second type of non-visual feedback, wherein the non-visual feedback is a first type of non-visual feedback.

In some embodiments, the one or more hardware processors are further configured to: determine whether one or more criteria are satisfied; and in response to determining that the one or more criteria are satisfied, determining whether the rotational position of the steerable component about the steering axis has reached a centered position.

In some embodiments, wherein the one or more criteria includes at least one of the following: a speed criteria associated with a speed threshold; and a steering angle criteria associated with a steering angle threshold; and wherein the one or more hardware processors are further configured to: compare (a) a speed over ground of the marine vessel to the speed threshold, and determine that the speed criteria is satisfied in response to determining that the speed over ground of the marine vessel is less than the speed threshold; or (b) a steering angle of the steerable component to the steering angle threshold, and determine that the steering criteria is satisfied in response to determining that the steering angle is less than the steering angle threshold; and determining that the one or more criteria are satisfied based on: (i) the speed criteria being satisfied; (ii) the steering angle criteria being satisfied; or (iii) the speed criteria being satisfied and the steering angle criteria being satisfied.

In some embodiments, the one or more hardware processors are further configured to: determine whether a steering angle of the steerable component has exceeded a feedback threshold angle since a last time that the steerable component was at the centered position; in response to determining that the steering angle of the steerable component has not exceeded the feedback threshold angle since the steerable component was at the centered position, inhibit the feedback device from providing the non-visual feedback when the steerable component is centered; and in response to determining that the steering angle of the steerable component has exceeded the feedback threshold angle since the steerable component was at the centered position, cause the feedback device to provide the non-visual feedback when the steerable component has returned to center.

In accordance with some embodiments of the disclosed subject matter, a method for providing non-visual feedback when a steerable component of a marine vessel returns to center is provided, the method comprising: determining that a rotational position of a steerable component about a steering axis has reached a centered position, wherein the steerable component is coupled to the marine vessel and configured to rotate about the steering axis to affect a direction of movement of the marine vessel; and in response to determining that the rotational position of the steerable component about the steering axis has reached the centered position, causing a feedback device to provide non-visual feedback via a steering input device to which the feedback device is coupled.

BRIEF DESCRIPTION OF THE DRAWINGS

The present disclosure is described with reference to the following drawings.

DETAILED DESCRIPTION

At relatively slow speeds, many boats react more slowly to steering input (e.g., the time between when a steering component is turned and when the direction of the vessel changes often increases at slower speeds due to). For example, there can be a lag between when a steering component (e.g., a motor, a rudder, etc.) is turned, and when the boat begins changing direction. Additionally, many boats do not provide a visual or easily viewable reference to indicate a steering angle to an operator during operation of the vessel. Such a lag can cause oversteering, understeering, and movement of the boat in an unintended direction. This is often experienced when docking a boat, loading a boat onto a trailer, or simply driving a boat at slow no wake speeds. This can lead to an operator of the boat over steering when the boat does not response to an initial steering input, which can then lead to the operator steering (or oversteering) in the other direction to compensate for the initial oversteering. This can cause "sawing" of the steering wheel and undesirable boat response. For example, when navigating under a bridge or around another obstruction at low speed, an operator may desire to make a relatively small adjustment to a direction of the boat, but may oversteer and/or over correct (e.g., due to an increased response time to steering inputs). As another example, when trailering a boat, the steering may not be straight for a final push used to get on the bunks of the trailer. When applying throttle to attempt to push the boat sufficiently onto the trailer, a drive angle may inadvertently be at an undesirable angle, which can lead to the operator attempting to make adjustments and/or fail to trailer the boat. As yet another example, when launching during watersports, an operator may attempt to make small corrections to steering (e.g., to center the steering, to steer in a particular direction) before pulling a person out of the water, but a lack of reliable feedback when stopped or moving slowly may lead to launching with a different steering angle than intended. Different boats may react differently based on size, hull shape, steering components, etc.

In some embodiments, mechanisms described herein can provide non-visual feedback to an operator of a boat that is indicative of a steering angle of a steering component (e.g., an outboard motor, a rudder, etc.). For example, mechanisms described herein can determine a steering angle of the steering component(s), and can provide non-visual feedback (e.g., haptic feedback, force feedback, audio feedback, etc.) when the steering component is at a particular steering angle (e.g., centered, close to centered, etc.).

Figure 1:
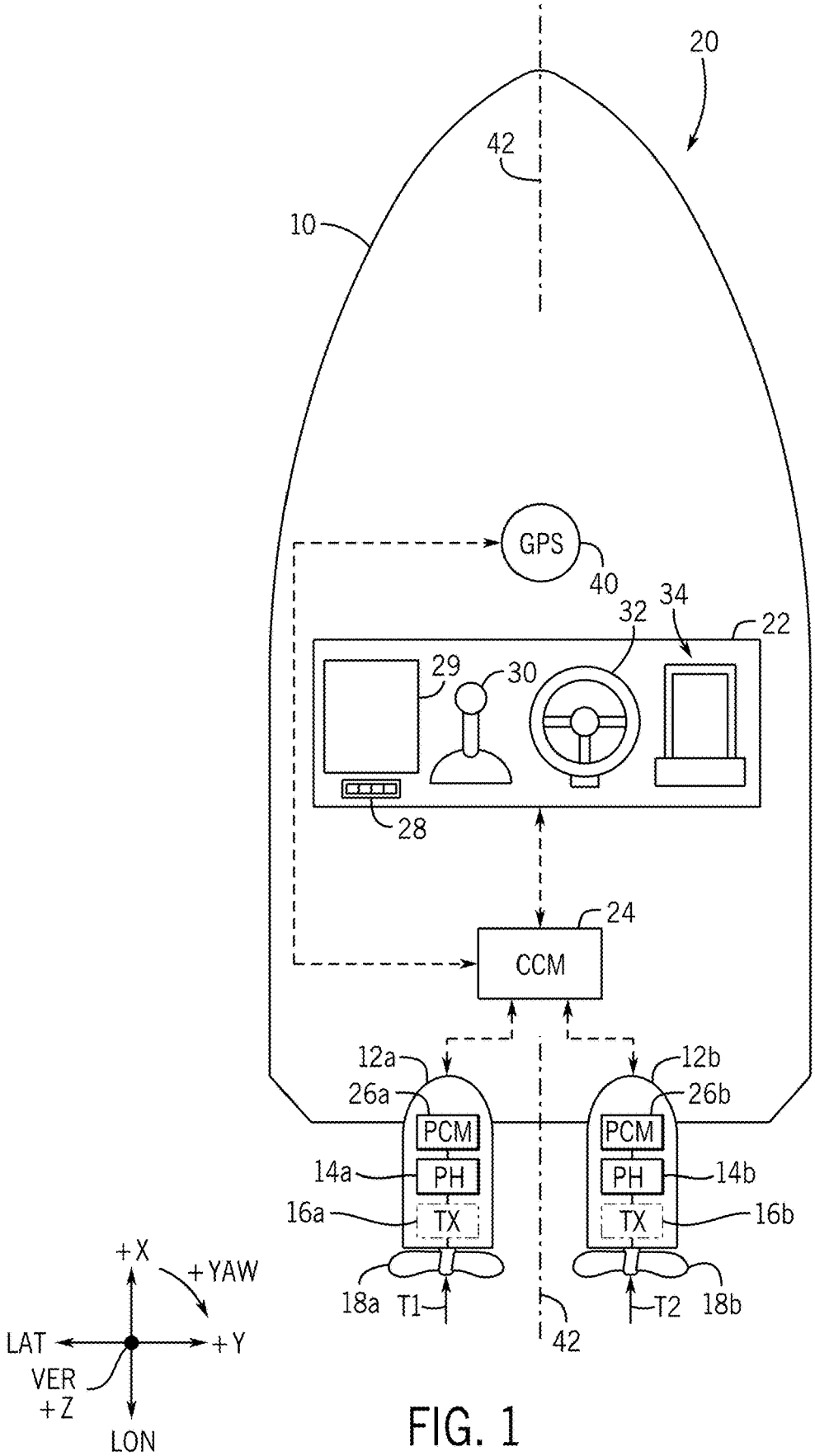
FIG. 1 shows an example of a propulsion system on a marine vessel in accordance with some embodiments of the disclosure.

FIG. 1 shows an example of a schematic representation of a propulsion system on a marine vessel in accordance with some embodiments of the disclosed subject matter. FIG. 1 shows a marine vessel 10 equipped with a propulsion system 20 on marine vessel 10 configured in accordance with some embodiments of the disclosed subject matter. In some embodiments, propulsion system 20 can be configured to operate, for example, in a joysticking mode in which a joystick is operated by a user to control vessel movement within an x/y plane, among other modes (e.g., as described hereinbelow). In some embodiments, propulsion system 20 can include first and second propulsion devices 12*a*, 12*b* that produce first and second thrusts T1, T2 to propel the vessel 10. First and second propulsion devices 12*a*, 12*b* are illustrated as outboard motors, but can alternatively be inboard motors, stern drives, jet drives, pod drives, any other suitable propulsion device, or combinations thereof. Each propulsion device can be provided with a powerhead 14*a*, 14*b* operatively connected to a transmission 16*a*, 16*b*, in turn, operatively connected to a propeller 18*a*, 18*b*.

In some embodiments, vessel 10 can also house various control elements that comprise part of the marine propulsion system 20. For example, marine propulsion system 20 can comprise an operation console 22 in signal communication (e.g., via a controller area network (CAN) bus) with a controller 24, such as a command control module (CCM), and with propulsion control modules (PCM) 26*a*, 26*b* associated with the respective propulsion devices 12*a*, 12*b*. Each of controller 24 and PCMs 26*a*, 26*b* can include memory and a programmable processor. For example, each control module 24, 26*a*, 26*b* can include one or more processors communicatively connected to a respective storage system comprising a computer-readable medium that includes volatile and/or nonvolatile memory upon which computer-readable code and data can be stored. Additionally or alternatively, in some embodiments, a processor(s) of one or more of control modules 24, 26*a*, 26*b* can be communicatively connected to a shared storage system comprising a computer-readable medium that includes volatile and/or nonvolatile memory upon which computer-readable code and data can be stored.

Note that although mechanisms described herein are generally described in connection with an internal combustion engine (ICE) propulsion system that includes a powerhead implemented using an ICE engine, mechanisms described herein can be used in connection with a propulsion system that includes any other suitable powerhead(s), such as one or more electric motors, or any suitable combination of powerheads. For example, propulsion devices 12*a*, 12*b* can be replaced by, or used in combination with, one or more propulsion devices that produce thrust to propel vessel 10 using an electric motor, such as an electric outboard motor, electric inboard motor, electric stern drive, electric jet drive, electric pod drive, any other suitable propulsion device, or combinations thereof, that is implemented using an electric motor (e.g., which can be implemented as a motor that is directly connected to a propulsor shaft without a transmission, such as transmission 16*a*, 16*b*). Additionally, although mechanisms described herein are generally described in connection with a propulsion system that uses two propulsion devices positioned at a stern of the vessel, fewer or more propulsion devices can be provided (e.g., including a single ICE propulsion device) in any suitable position(s).

In some embodiments, operation console 22 can include any suitable number of user input devices, such as, a keypad 28, a joystick 30, a steering wheel 32, one or more throttle/shift levers 34, etc., and any suitable number of output devices, such as a display 29, a heads-up display (HUD), one or more speakers (not shown), one or more sound producing devices (e.g., an air horn(s), a bell(s), a whistle(s), etc.), etc. In some embodiments, each of the input devices can be configured to input commands to controller 24, which can, in turn, communicate control instructions to first and second propulsion devices 12*a*, 12*b* by communicating with PCMs 26*a*, 26*b*. In some embodiments, steering wheel 32 and throttle/shift lever(s) 34 can function in a conventional manner, such that rotation of steering wheel 32, for example, activates a transducer that provides a signal to controller 24 regarding a desired direction of the vessel 10. Controller 24 can, in turn, send signals to PCMs 26*a*, 26*b* (and/or a thrust vector module(s) (TVMs), or additional modules if provided), which in turn can activate one or more steering actuators to achieve desired orientations of propulsion devices 12*a*, 12*b*. In some embodiments, propulsion devices 12*a*, 12*b* can be independently steerable about a respective steering axis. Throttle/shift lever(s) 34 can send signals to controller 24 regarding a desired gear (e.g., forward, reverse, or neutral) of transmissions 16*a*, 16*b* and desired rotational speed (and/or any other value indicative of a thrust command) of powerheads 14*a*, 14*b* of propulsion devices 12*a*, 12*b*. Controller 24 can, in turn, send signals to PCMs 26*a*, 26*b*, which in turn activate electromechanical actuators in transmissions 16*a*, 16*b* and powerheads 14*a*, 14*b* for shift and throttle, respectively. A manually operable input device that facilitates control along multiple degrees of freedom, such as joystick 30, can also be used to provide signals to controller 24. In some embodiments, joystick 30 can be used to allow an operator of vessel 10 to manually maneuver vessel 10 along a particular degree of freedom, such as to achieve lateral translation or rotation of vessel 10, or along multiple particular degrees of freedom, such as to achieve translation along a direction other than fore or aft (e.g., a direction not aligned with a heading of the vessel) or simultaneous translation and rotation of vessel 10.

In some embodiments, a sensor(s) (and/or other source of positional feedback) can provide a signal to controller 24 regarding a position of propulsion devices 12*a*, 12*b*, which can correspond to an angle (or other suitable measure of rotational displacement) between a longitudinal centerline 42 of marine vessel 10 (or a line parallel thereto, if the steering system 10 includes multiple propulsion devices). For example, when a propulsion device (e.g., propulsion device 12*a* and/or 12*b*) is positioned such that thrust vectors T1 and T2 are parallel to longitudinal centerline 42, the propulsion device can be described as at a zero position, or a centered position.

Note that although mechanisms described herein are generally described in connection with steering that is accomplished via rotation of a propulsion device about an axis, mechanisms described herein can be used in connection with a propulsion system that includes any suitable steerable component that can cause a change in a direction of thrust that impacts a heading of vessel 10. For example, in a stern drive, a portion of a propulsion device can be in a fixed position, and another portion of the propulsion device can be rotated (e.g., including a propeller shaft that connects to a propeller) to provide steering. As another example, vessel 10 can include a rudder that can be used to provide steering (e.g., in connection with a propeller or other propulsor that remains in a fixed position, such as on an inboard drive).

In some embodiments, output devices, such as display 29, speakers, etc., can be configured to present (e.g., visually, audibly, etc.) any suitable data, information, image data (e.g., images captured by one or more devices that include an image sensor(s)), received from controller 24, from another controller or processor, and/or generated based on data and/or information received from controller 24, another controller, and/or processor. For example, display 29 can present information about speed, heading, steering angle, etc. In some embodiments, display 29 can be any suitable display, such as a multi-function display (MFD). In some embodiments, display 29 can be used to present a user interface, which can be implemented as a touchscreen or display that is capable of receiving input via a touchscreen. In some embodiments, one or more other input devices can be used to interact with a user interface (e.g., a graphical user interface) presented by display 29, such as a keypad (e.g., keypad 28), a keyboard, a track ball, a track pad, any other suitable user input device, and/or suitable combination of user input devices. In some embodiments, vessel 10 can include multiple displays 29, which can be integrated into operation console 22, integrated into another portion of vessel 10, and/or mechanically mounted to operation console 22 or another portion of vessel 10. In some embodiments, display 29 can be used to present alerts, menus, operational data (e.g., throttle, speed, heading, engine output, etc.), maps, charts, settings that can be used to configure another display, etc. In some embodiments, display 29 can be omitted. For example, where a mobile device, such as a tablet computer, laptop computer, head-mounted display, etc. is configured to present a user interface of vessel 10.

In some embodiments, vessel 10 can have a GPS receiver 40 comprising part of a satellite-based radio navigation system (e.g., a global navigation satellite system (GNSS)), such as the global positioning system (GPS). GPS receiver 40 can be located at a pre-selected fixed position on vessel 10, which provides information related to a position of vessel 10 with respect to a planetary frame of reference (e.g., latitude, longitude, and height with respect to sea level). In some embodiments, GPS receiver 40 can also be located at a known and fixed position with respect to the center of rotation (COR) and/or center of gravity (COG) of vessel 10 (e.g., a COG when the vessel is empty). In some embodiments, position data from GPS receiver 40 can be provided to any suitable controller (e.g., CCM 24, etc.). In some embodiments, as shown in FIG. 1, position data can be communicated to controller 24, which can be via any suitable wired or wireless communication technique(s), such as via a dedicated communication bus, wireless transmission protocols (e.g. Bluetooth, Bluetooth Low Energy (BLE), ZigBee, ultra-wideband (UWB), etc.), a CAN bus comprising part of the vessel network, etc. Note that the dashed connection lines in FIG. 1 are meant to show only that the various control elements are capable of communicating with one another, and do not necessarily represent actual wiring connections between the control elements, nor do they represent the only paths of communication between the elements.

In some embodiments, vessel 10 can include one or more inertial measurement units (IMUs) (not shown) installed at a known location(s) on the marine vessel. In some embodiments, such an IMU(s) can be located at a known and fixed position with respect to the center of rotation (COR) and/or center of gravity (COG) of vessel 10 (e.g., a COG when the vessel is empty). In some embodiments, vessel 10 can include an inertial navigation system (INS), such as including one or more micro-electro-mechanical systems (MEMS). For example, an INS can include a MEMS angular rate sensor, such as a rate gyro, a MEMS accelerometer, and a magnetometer. Additionally or alternatively, in some embodiments, motion and angular position (including pitch, roll, and yaw) can be sensed by an INS 60, or by an attitude heading reference system (AHRS) that provides 3D orientation of vessel 10 by integrating gyroscopic measurements, accelerometer data, and magnetometer data. In some embodiments, one or more IMUs of vessel 10 can be included as part of an INS or AHRS.

In some embodiments, each processor (e.g., a processor of one or more of control modules 24 and 26, a processor associated with steering wheel 32, joystick 30, operation console 22, etc.) can access computer-readable code and, upon executing the code, carry out one or more functions, such as determining when a steerable element is centered, determining when a steerable element is to be monitored, causing feedback to be provided via a steering input device when one or more conditions, including a steerable device returning to center, are satisfied, as described in more detail below.

As another example, as described below in connection with FIG. 4, mechanisms described herein can determine that a steerable element (e.g., a steerable propulsion device, a rudder, etc.) has returned to center, and can provide non-visual feedback to an operator, which can mitigate oversteering or understeering, especially at relatively slow speeds.

In some embodiments, mechanisms described herein can be configured to use information indicative of a steering angle of a steerable component to determine whether the steerable component has returned to center, and provide feedback non-visual feedback to an operator indicative of the steerable component returning to center. For example, as described below in connection with FIGS. 3A to 4, mechanisms described herein can use a steering angle of a steerable component to determine when to provide feedback about a steering angle of the steerable device, whether the steerable device has returned to center, and provide feedback in response to determining that steerable device has returned to center.

Figure 2:
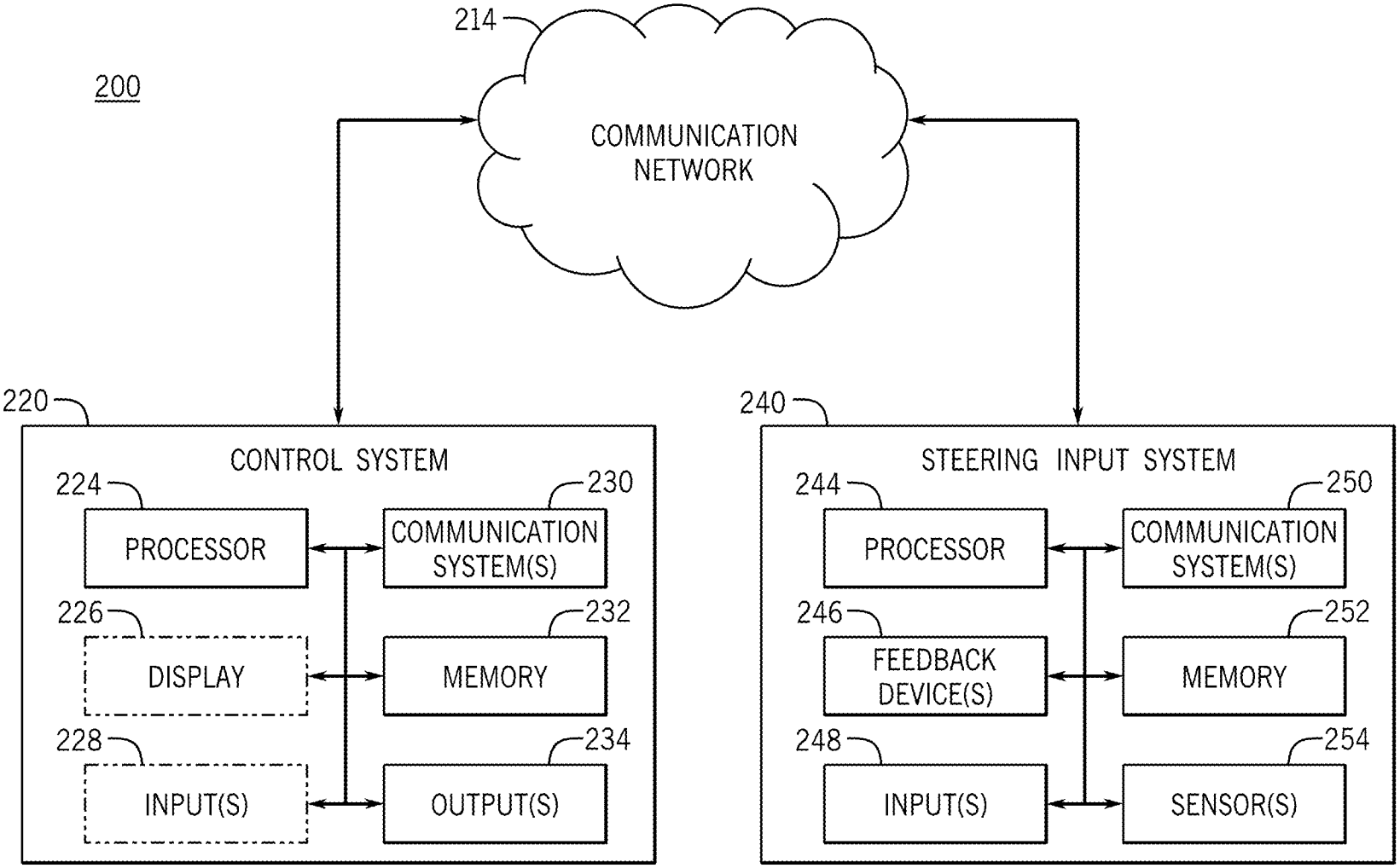
FIG. 2 shows an example of hardware that can be used to implement a control system, and a steering input system in accordance with some embodiments of the disclosure.

FIG. 2 shows an example of hardware 200 that can be used to implement a control system 220 and a steering input system 240 in accordance with some embodiments of the disclosed subject matter.

In some embodiments, control system 220 can include a processor 224, a display 226, one or more inputs 228, one or more communication system(s) 230, memory 232, and/or one or more output devices 234. In some embodiments, processor 224 can be any suitable hardware processor or combination of processors, such as a central processing unit (CPU), an accelerated processing unit (APU), a graphics processing unit (GPU), a field programmable gate array (FPGA), an application specific integrated circuit (ASIC), etc. In some embodiments, display 226 can include any suitable display devices, such as a computer monitor, a touchscreen, a television, etc. In some embodiments, inputs 228 can include any suitable input devices and/or sensors that can be used to receive user input, such as a throttle lever (e.g., throttle lever 34), a joystick (e.g., joystick 30), a keyboard, a mouse, a touchscreen, a microphone, etc. In some embodiments, control system 220 can omit display 226 and/or inputs 228 (e.g., where control system 220 is an embedded device that is not configured for direct user interaction). For example, control system 220 can receive information indicative of a steering angle of a steerable component (e.g., propulsion device 12, a rudder), determine whether the steerable component has returned to center, and cause an alert (e.g., non-visual feedback) to be provided to an operator (e.g., via a feedback output device associated with a steering input device) that indicates the centered position of the steerable component. In some embodiments, any suitable controller and/or control module (e.g., CCM 24, a mobile computing device such as a smartphone, wearable computing device, etc., and/or any other suitable control system) can be used to implement control system 220.

In some embodiments, communication system(s) 230 can include any suitable hardware, firmware, and/or software for communicating information over a communication network 214 and/or any other suitable communication networks. For example, communication system(s) 230 can include one or more transmitters, one or more receivers, one or more transceivers, one or more communication chips and/or chip sets, etc., that can be used to establish a wired and/or wireless communication link. In a more particular example, communication system(s) 230 can include hardware, firmware, and/or software that can be used to establish a direct or indirect wired connection and/or a direct or indirect wireless connection, such as a CAN bus connection, a Bluetooth connection, Bluetooth Low Energy (BLE) connection, a ZigBee connection, a Wi-Fi connection, a cellular connection (e.g., an uplink connection, a downlink connection, or a sidelink connection), an ultra-wideband (UWB) connection, an Ethernet connection, etc.

In some embodiments, memory 232 can include any suitable storage device or devices that can be used to store instructions, values, etc., that can be used, for example, by processor 224 to determine a steering angle of a steerable component, to communicate with one or more components of steering input system 240 via communications system(s) 230, etc. Memory 232 can include any suitable volatile memory, non-volatile memory, storage, or any suitable combination thereof. For example, memory 232 can include random access memory (RAM), read-only memory (ROM), electronically erasable programmable read-only memory (EEPROM), one or more flash drives, one or more hard disks, one or more solid state drives, one or more optical drives, etc.

In some embodiments, memory 232 can have encoded thereon a computer program for controlling operation of control system 220. In such embodiments, processor 224 can receive information from a steerable component and/or a device associated with a steerable component (e.g., a sensor, an actuator, a controller, etc.), can receive information from steering input system 240 and/or a steering input device, determine whether an alert is to be generated when the steerable component is returned to center, determine whether the steerable component has returned to center, and cause an alert (e.g., non-visual feedback, such as vibration, resistance to turning, etc.) to be provided to an operator (e.g., via a feedback output device associated with a steering input device) that indicates the centered position of the steerable component, to execute at least a portion of a process for providing non-visual feedback when a steerable component (e.g., a marine propulsion device) of a marine vessel returns to center, such as processes described below in connection with FIG. 4, etc.

In some embodiments, communication network 214 can be any suitable communication network or combination of communication networks. For example, communication network 214 can include a Wi-Fi network (which can include one or more wireless routers, one or more switches, etc.), a peer-to-peer network (e.g., a Bluetooth network, a UWB network), a cellular network (e.g., a 3G network, a 4G network, a 5G network, etc., complying with any suitable standard(s), such as CDMA, GSM, LTE, LTE Advanced, 5G NR, etc.), a wired network, etc. In some embodiments, communication network 214 can include one or more portions of a control area network (CAN), a local area network (LAN), a wide area network (WAN), a public network (e.g., the Internet, which may be part of a WAN and/or LAN), any other suitable type of network, or any suitable combination of networks. Communications links shown in FIG. 2 can each be any suitable communications link or combination of communications links, such as wired links, fiber optic links, Wi-Fi links, Bluetooth links, UWB links, cellular links, etc.

In some embodiments, steering input system 240 can include a processor 244, a feedback device 246, one or more inputs 248, one or more communication system(s) 250, memory 252, and/or one or more sensors 254. In some embodiments, processor 244 can be any suitable hardware processor or combination of processors, such as a CPU, an APU, a GPU, an FPGA, an ASIC, etc.

In some embodiments, feedback device 246 can include any suitable device that can be configured to provide non-visual feedback, such as a device that can provide haptic feedback, force feedback, auditory feedback, etc. For example, feedback device 246 can include a haptic feedback device (e.g., implemented using an eccentric rotating mass (ERM) actuator(s), using one or more piezoelectric actuators, etc.) integrated into, or coupled to, a component of steering input system 240 (e.g., a steering input device such as a steering wheel) or another component of marine vessel 10 that an operator is likely to be in physical contact with during steering. In such an example, the haptic feedback device can be used to provide haptic feedback that provides tactile feedback to an operator during steering.

As another example, feedback device 246 can include a force feedback device integrated into, or coupled to, a component of steering input system 240. In such an example, the force feedback device can be used to impact movement of a steering input device (such as a steering wheel) during steering, such as through an increased resistance to movement (e.g., rotation) of the steering input device, which can provide non-visual feedback to an operator using the steering input device to provide steering control input. In such an example, a force feedback device can be implemented using a resistance device, that can be configured to apply a resistance force to resist rotation of the steering wheel, such as by applying the resistance force to a steering column coupled to the steering wheel, which can be implemented using any suitable technique or combination of techniques, such as any type of electrical, mechanical and/or hydraulic device that is operable to variably resist rotational movement of a steering wheel based upon commands from a controller (e.g., control system 220). In a more particular example, the resistance device of feedback device 246 can be implemented using a mechanical clamp (or other suitable device) that can be selectively mechanically engaged with a portion of the steering input device (e.g., the steering column attached to the steering wheel) via an electric motor and/or a hydraulic pump that controls a position of the mechanical clamp (or other suitable device) and/or a pressure exerted by the mechanical clamp on the steering input device. As another more particular example, the resistance device of feedback device 246 can be implemented using an electric motor (or other suitable device, such a hydraulic circuit) that is directly coupled to the steering input device (e.g., to a steering column). In such an example, the electric motor (or other suitable device, such a hydraulic circuit) can be configured to rotate the steering input device and/or resist rotation of the steering input device. As yet another example, the resistance device of feedback device 246 can be implemented using an electric brake that is magnetically coupled to a component of the steering input device or a component coupled to the steering input device. In such an example, the electric brake can be configured to apply torque without being physically coupled to a component of the steering input device (e.g., a magnetic hysteresis break, or an eddy current brake). As still another more particular example, the resistance device of feedback device 246 can be implemented using a clutch brake mechanism coupled to the steering input device (e.g., to a steering column). In such an example, the clutch brake mechanism can be configured to resist rotation of the steering input device (e.g., using a braking force applied to the clutch via a controlled solenoid). As a further more particular example, the resistance device of feedback device 246 can be implemented using a magneto-rheological fluid (MRF) braking mechanism coupled to the steering input device (e.g., to a steering column) and capable of applying a variable braking force thereon.

In some embodiments, inputs 248 can include any suitable input device(s) that can be used to receive user input, such a steering wheel (e.g., steering wheel 32), a joystick (e.g., joystick 30), etc., that can be used to provide steering input. Additionally, in some embodiments, inputs 248 can include any suitable additional input device(s), such as a touchscreen, a trackpad, one or more buttons, a microphone, a keyboard, a mouse, a gaze tracking system, etc. In some embodiments, steering input system 240 can omit one or more inputs (e.g., one or more steering input devices and/or additional input devices.

In some embodiments, communication system(s) 250 can include any suitable hardware, firmware, and/or software for communicating information over communication network 214 and/or any other suitable communication networks. For example, communication system(s) 250 can include one or more transceivers, one or more communication chips and/or chip sets, etc., that can be used to establish a wired and/or wireless communication link. In a more particular example, communication system(s) 250 can include hardware, firmware, and/or software that can be used to establish a direct or indirect wired connection and/or a direct or indirect wireless connection, such as a CAN bus connection, a Bluetooth connection, Bluetooth Low Energy connection, a ZigBee connection, a UWB connection, a Wi-Fi connection, a cellular connection (e.g., an uplink connection, a downlink connection, or a sidelink connection), an Ethernet connection, etc. In some embodiments, communication system(s) 250 can be configured to communicate directly with control system 220. For example, such a direct connection can be a two-way communication link between steering input system 240 and control system 220, such as a wired communication link (e.g., a direct serial or parallel communication link), a Bluetooth connection, a UWB connection, a sidelink connection, etc.

In some embodiments, memory 252 can include any suitable storage device or devices that can be used to store instructions, values, etc., that can be used, for example, by processor 244 to generate an alert via feedback device 246, receive input via input(s) 248, to communicate with control system 220 via communications system(s) 250, etc. Memory 252 can include any suitable volatile memory, non-volatile memory, storage, or any suitable combination thereof. For example, memory 252 can include RAM, ROM, EEPROM, one or more flash drives, one or more hard disks, one or more solid state drives, one or more optical drives, etc.

In some embodiments, sensor(s) 254 can include components that are used to measure data about a position of a steering input device, a user, and/or an environment. For example, sensor(s) 254 can include a position sensor associated with a steering wheel (e.g., steering wheel 32) configured to measure a rotational position of the steering wheel. As another example, sensor(s) 254 can include a position sensor(s) associated with a joystick (e.g., joystick 30) configured to measure a rotational position of the joystick along multiple axes of rotation, and/or a position of the joystick along one or more axes of translation. As yet another example, sensor(s) 254 can include a sensor (e.g., a conductive, capacitive, and/or optical sensor) configured to determine whether an operator is touching a particular component (e.g., a particular steering input device).

In some embodiments, memory 252 can have encoded thereon a computer program for controlling operation of steering input system 240. In such embodiments, processor 244 can execute at least a portion of the computer program to receive information from control system 220 (e.g., via communication system(s) 230), present an alert (e.g., non-visual feedback), to transmit information to control system 220, to execute at least a portion of a process for providing non-visual feedback when a marine propulsion device of a marine vessel returns to center, such as processes described below in connection with FIG. 4, etc.

Figure 3A:
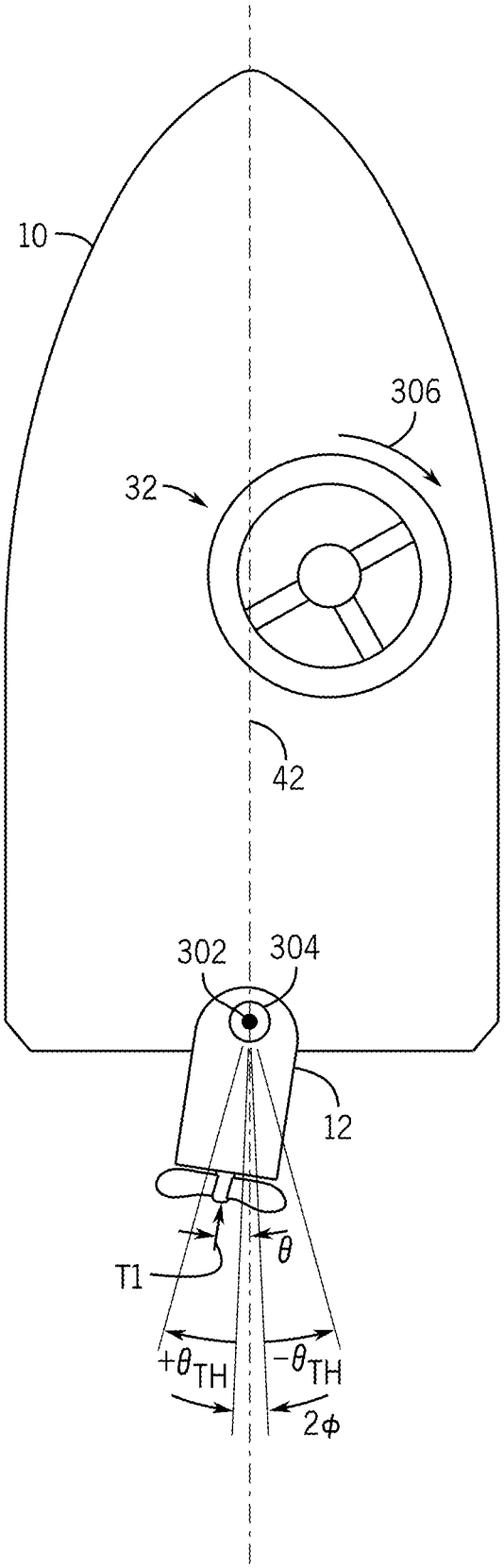
FIG. 3A shows an example of a steerable device in a turned position and a position of a steering wheel in accordance with some embodiments of the disclosure.
Figure 3B:
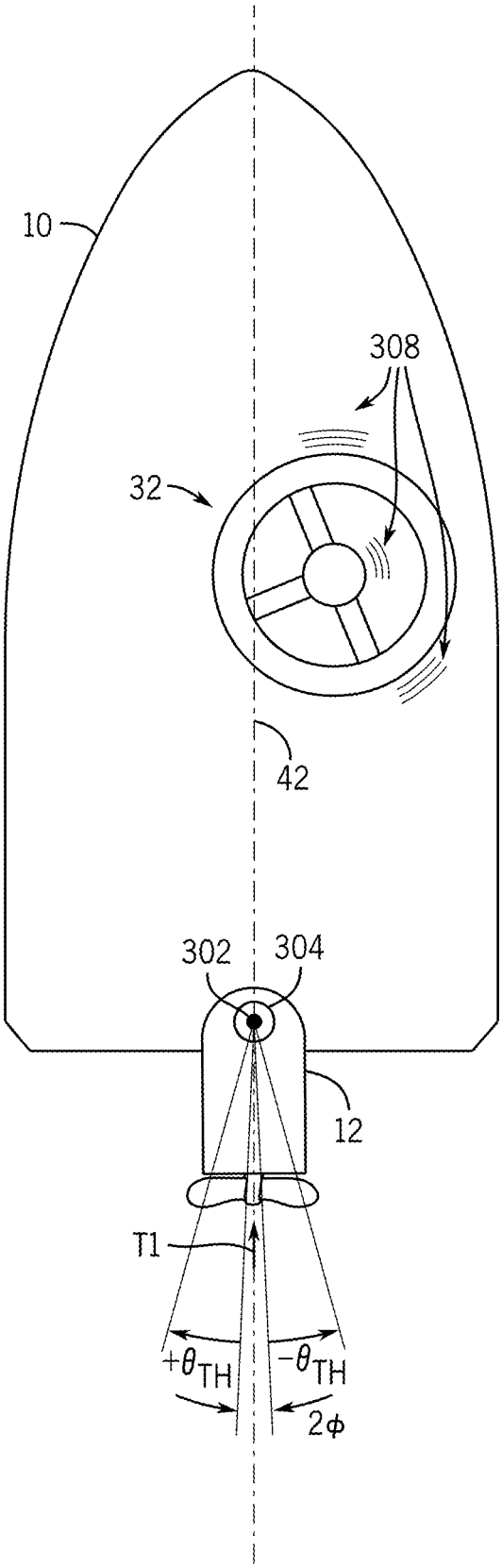
FIG. 3B shows an example of the steerable device in a centered position and a corresponding position of the steering wheel in accordance with some embodiments of the disclosure.

FIGS. 3A and 3B show an example of a steerable component in a turned position and a centered position, and corresponding positions of a steering wheel in accordance with some embodiments of the disclosure. As shown in FIGS. 3A and 3B, a steering input device, such as a steering wheel, becomes misaligned from the steerable component of a marine vessel, such that a center position of a steering device does not align with a center position of the steerable device. Accordingly, using the position of the steering input device as a visual cue may not be a reliably technique for an operator to determine when the steerable component has returned to center.

In some embodiments, mechanisms described herein can be used in connection with an electronically controlled steering system (e.g., without a direct mechanical link between a steering input device and an actuator that changes a steering angle of a steerable device), which is sometimes referred to as a "steer-by-wire" system. In such a system, control can be provided by one or more controllers (e.g., controller 24, PCM 26, etc.) receiving inputs from various components in a steering system (e.g., a sensor of sensor(s) 254, processor 244, etc.) and controlling a steering actuator based on the input(s). In some embodiments, a particular amount of rotation of steering wheel 32 can correspond to a particular amount of rotation of a steerable component (e.g., propulsion device 12). A relationship between rotation of the steering wheel and a steerable component can be based, for example, one or more drive angle maps stored in memory of a controller (controller 24, PCM 26, etc.). In some embodiments, a relationship steering wheel rotation and steerable component rotation can vary for a particular marine vessel depending on vessel conditions, such as vessel speed, propulsor speed, propulsor load, etc. A drive angle map can associate a sensed position of a steering wheel with a particular position of a steerable component and/or a steering actuator. For example, a position of a steering input device (e.g., steering wheel 32) can be sensed by a position sensor (e.g., an encoder, transducer, or other type of position sensor). As another example, a position of a steering input device (e.g., steering wheel 32) can be characterized as a normalized steering value (e.g., steering wheel position can be normalized, such as to a scale between −100% and 100%, −1 to 1, etc.), and movement of the a steerable component can be based on the normalized steering value.

In the example of FIGS. 3A and 3B, propulsion device 12 can be steered around a vertical steering axis 302. Note that different types of marine vessels and steerable components can use different orientations and/or types of steering axes. In the example of FIGS. 3A and 3B rotation about steering axis 302 can be controlled using a steering actuator 304, which can actuate propulsion device 12 to various different rotational positions about centerline 42, which can be used to control a direction of movement of marine vessel 10. In some embodiments, steering actuator 304 can be implemented using any suitable technique or combination of techniques. For example, steering actuator 304 can be implemented as a hydraulic, electric, or electric over hydraulic steering actuator. In a more particular example, steering actuator 304 can be a hydraulic pump that pumps pressurized hydraulic fluid through a control valve to either side of a piston cylinder to control movement of a steerable component(s), such as propulsion device 12. A position sensor can be located on or associated with steering actuator 304 and/or the steerable component (e.g., propulsion device 12) to measure a steering position or steering angle of the steerable component (which is sometimes referred to herein as a component position or drive angle). In some embodiments, a steering angle can be characterized as a distance or an angle θ between a center axis of the steerable component (e.g., an axis that is parallel to thrust T1 provided by propulsion device 12 in the example of FIGS. 3A and 3B) and centerline 42 of marine vessel 10 (or a line parallel to centerline 42, if vessel 10 includes multiple steerable components, such as multiple propulsion devices).

In some embodiments, the steerable component can be associated with a maximum steering angle, which can be the same in each direction, or different (e.g., to avoid collisions with neighboring steerable devices, or portions of vessel 10). For example, propulsion device 12 can have a maximum steering angle of 30° in each direction (e.g., a range within ~±30° of centerline 42). Note that the maximum steering angle can be vary based on various characteristics of the propulsion system and/or vessel parameters. For example, the maximum steering angle can be based on a steering mechanism being used (e.g., different steering mechanisms can have different steering ranges), based on the type and/or size of propulsion device being used (e.g., some sterndrives can have a larger steering range, an outboard motor with a steerable gearcase can have a larger steering range, etc.), spacing between multiple propulsion devices (e.g., if multiple propulsion devices are used, a maximum steering angle can be limited in a direction that may cause a collision between neighboring propulsion devices), a speed and/or steering wheel input (e.g., at faster speeds and/or sharper steering angles, a drive by wire system can limit steering angle to a narrower range). In some embodiments, a steerable component can be considered centered when an axis of the steerable component is substantially parallel with centerline 42. Such a position is sometimes referred to as a zero position. In some embodiments, mechanisms described herein can determine that a steerable component (e.g., propulsion device 12) is centered when the position of the steerable component is equal zero, or within a predetermined range of zero (e.g., ±1°, ±2°, ±3°, etc.). In some embodiments, mechanisms described herein can determine that a steerable component has returned to center (or returned to zero) when the steering angle θ exceeds a feedback threshold angle ϕ (e.g., if θ becomes greater than ±ϕ), and then returns to zero. For example, feedback threshold angle ϕ can be a hysteresis value used to inhibit feedback while the steering angle remains relatively close to zero. In a more particular example, if, after the steering angle previously returned to zero (or to within a predetermined range of zero), as long as the steering angle does not exceed ±ϕ of center, mechanisms described herein can omit monitoring the steering angle to determine if it has returned to zero (e.g., mechanisms described herein can inhibit a determination that the steering angle has returned to zero until the steering angle exceeds ±ϕ of center). As another more particular example, if, after the steering angle previously returned to zero (or to within a predetermined range of zero), the steering angle then exceeds ±ϕ of center, mechanisms described herein can determine that a steerable component has returned to center (or returned to zero) when the steering angle θ returns to zero. In some embodiments, ϕ can be any suitable value, such as about 5°.

As described below in connection with FIG. 4, in some embodiments, mechanisms described herein can monitor whether a steering angle has returned to zero (or has returned to center) when one or more conditions are satisfied. For example, if speed is above a threshold speed, vessel 10 may be more responsive to changes in steering, and motion of vessel 10 may provide sufficient non-visual feedback to indicate to an operator when the steering angle of the steerable element has returned to center. As another example, if a steering angle exceeds a threshold steering angle $\theta_{th}$ (e.g., if $\theta$ is greater than $\pm\theta_{th}$), feedback may not be necessary when the steering angle returns to zero relatively rapidly. In a more particular example, if the steering angle exceeds threshold steering angle $\theta_{th}$, it may be unlikely that the operator intends to return to zero if the steering angle is rapidly approaching zero, as it is likely that the operator intends to steer past zero if moving from a relatively large steering toward zero at relatively high speed (e.g., as described below in connection with 402 of FIG. 4).

In FIG. 3A, the steering angle of propulsion device 12 is greater than the feedback threshold ($\phi$), and less than a threshold steering angle ($\theta_{th}$), and an operator is rotating steering wheel 32 in a direction 306 to cause propulsion device 12 to be rotated back toward a centered position, from the current steering angle. In FIG. 3B, propulsion device 12 has returned to zero, and mechanisms described herein can cause steering wheel 32 to provide haptic feedback via vibration of one or more portions of steering wheel 32 (illustrated via lines 308), which can indicate to an operator that has a body part (e.g., a hand) in contact with steering wheel 32 that propulsion device 12 is centered. As described above, an operator that intends to center a steerable component may oversteer a steering wheel to cause vessel 10 to rotate the steerable component past center (e.g., due a lag between when a change in steering angle occurs and when vessel 10 begins turning). Alternatively, if the steering angle exceeded $\theta_{th}$ prior to the steering angle shown in FIG. 3A, whether mechanisms described herein can cause steering wheel 32 to provide haptic feedback can be based on whether the intent of the user appears to be to return to zero, or to steer to a relatively large angle in direction 306. For example, if the steering angle did not exceed $\theta_{th}$, mechanisms described herein can provide haptic feedback regardless of the rate at which the steering wheel is rotated in direction 306, as the intent of the operator is more likely to be to center the steering mechanisms. As another example, if the steering angle exceeded $\theta_{th}$, mechanisms described herein can provide haptic feedback if the rate at which the steering wheel is rotated in direction 306 is below a threshold (and/or meets any other suitable criterion or combination of criteria), as the intent of the operator is more likely to be to center the steering mechanisms, while if the rate at which the steering wheel is rotated in direction 306 exceeds the threshold mechanisms described herein can inhibit the haptic feedback from being provided when the steering mechanism is centered.

Figure 4:
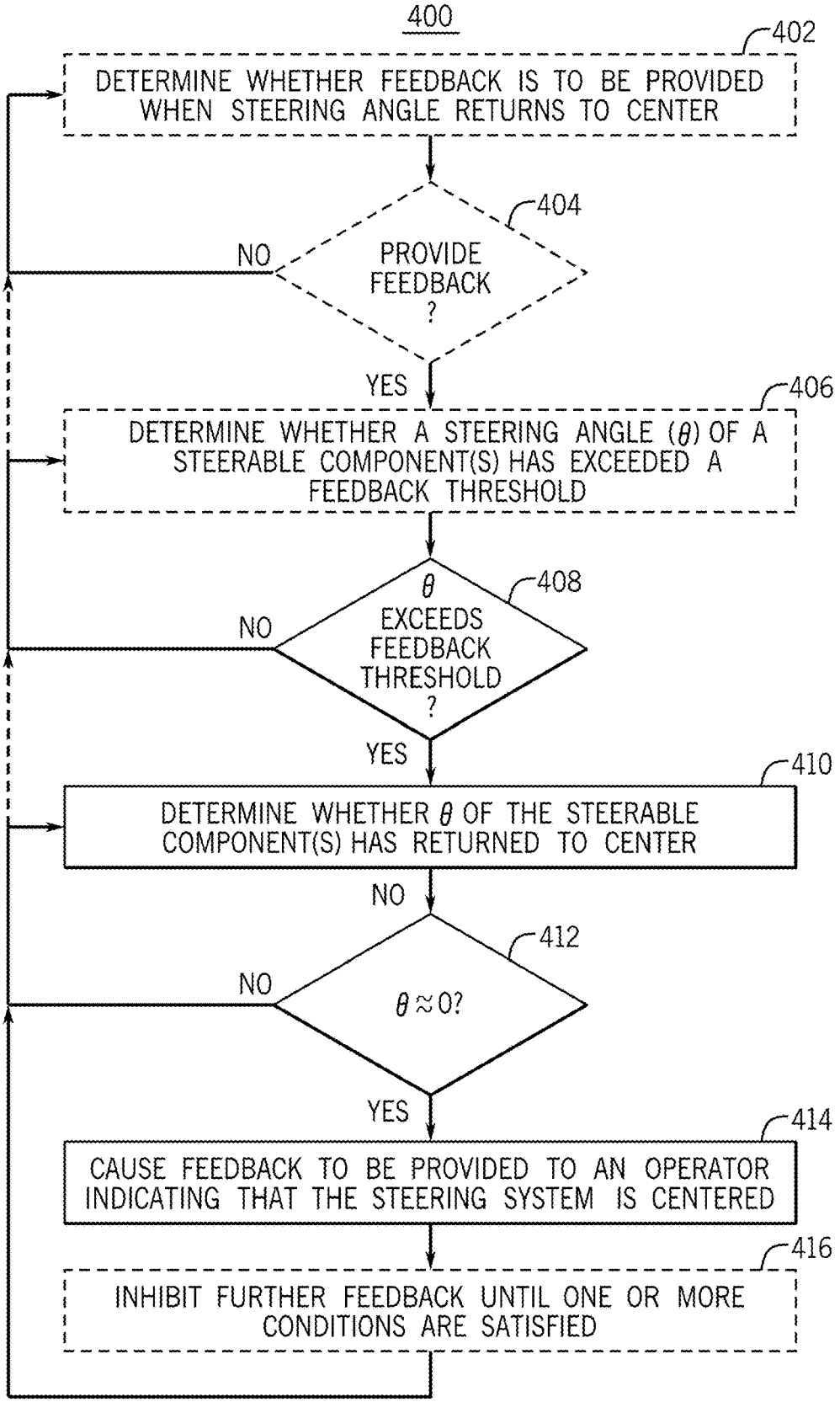
FIG. 4 shows an example of a process for providing non-visual feedback when a marine propulsion device of a marine vessel returns to center in accordance with some embodiments of the disclosed subject matter.

FIG. 4 shows an example of a process 400 for providing non-visual feedback when a marine propulsion device of a marine vessel returns to center in accordance with some embodiments of the disclosed subject matter.

At 402, process 400 can determine whether feedback is to be provided when a steering angle of a steerable component (s) returns to center. In some embodiments, process 400 can determine whether feedback is to be provided when a steering angle of a steerable component(s) returns to center based on one or more settings, and/or one or more conditions.

For example, in some embodiments, a user can adjust one or more settings (e.g., via a display, such as display 29 or a display of a mobile device paired with vessel 10) to control when and/or if feedback is provided when a steering angle of a steerable component(s) returns to center, and process 400 can determine whether feedback is to be provided based on the settings. In a more particular example, a user can provide input to adjust a setting indicative of whether feedback is to be provided when a steering angle of a steerable component(s) returns to center (e.g., to enable or disable such feedback). As another example, a user can provide input to adjust a setting indicative of whether feedback is to be provided within a particular range of speeds (e.g., only at slow speeds, up to a planning speed of the vessel, etc.). As yet another example, a user can provide input to adjust a setting indicative of whether feedback is to provided near a zero position of the steerable component, only when the steerable component reaches zero, or near a zero position of the steerable component and when the steerable component reaches zero. As still another example, a user can provide input to adjust a setting indicative of what type of feedback is to be provided (e.g., if vessel 10 is configured to provide multiple types of feedback).

As another example, in some embodiments, process 400 can determine whether a condition or combination of conditions are satisfied. In a more particular example, process 400 can determine whether vessel 10 is within a speed threshold (e.g., set by a manufacturer, dealer, installer, user, etc.). As another more particular example, process 400 can determine whether the steering angle stayed within a steering angle threshold (e.g., angle $\theta_{th}$ described above in connection with FIGS. 3A and 3B), and whether motion of the steering input device exceeds a rate threshold. In a more particular example, if a steering input device (e.g., steering wheel 32) is being rotated quickly (e.g., a threshold rate can be about 200 degrees per second) and started from a relatively large angle (e.g., an angle exceeding $\theta_{th}$), process 400 can determine that feedback on a centered position is not to be provided (e.g., as it may be unlikely that an operator is attempting to center the steerable component). In such an example, whether feedback is to provided when moving the input device quickly through a centered position of the steerable component can be adjusted (e.g., as a setting).

If process 400 determines that such feedback is not to be provided ("NO" at 404), process 400 can return to 402, and can monitor one or more conditions and/or settings to determine whether to provide feedback when the steering angle returns to center. Otherwise, if process 400 determines that such feedback is to be provided ("YES" at 404), process 400 can move to 406. In some embodiments, 402 and 404 can be omitted (e.g., where monitoring whether to provide feedback is always enabled, regardless of settings and/or conditions).

At 406, process 400 can determine whether a steering angle of a steerable component(s) of the marine vessel has exceeded a feedback threshold (e.g., an angle of +ø). For example, process 400 can determine whether the steering angle of the steerable component has moved at least a predetermined amount from a zero (or centered) position.

In some embodiments, process 400 can use any suitable technique to determine whether the steerable component has exceeded the feedback threshold. For example, process 400 can set a flag or signal (e.g., in memory and/or a component of a control circuit) to a particular value (e.g., high, low, 0, 1, etc.) when the steering angle exceeds the feedback threshold, and can be reset (e.g., to an initial value) when the steering angle returns to center. As another example, process 400 can store a maximum steering angle value that has been measured (e.g., in memory and/or a component of a control circuit), and can compare the maximum steering angle value to the feedback threshold. In such an example, the value can be reset when feedback is provided and/or when the steering angle returns to center.

If process 400 determines that the steering angle has not exceeded the feedback threshold ("NO" at 408), process 400 can return to 406 and/or 402. Otherwise, if process 400 determines that the steering angle has exceeded the feedback threshold ("YES" at 408), process 400 can move to 410. In some embodiments, 406 and 408 can be omitted (e.g., where feedback is provided whenever the steerable components approaches, becomes, and/or passes a zero position).

At 410, process 400 can determine whether the steering angle (e.g., 0) of the steering component(s) has returned to center. In some embodiments, process 400 can determine that the steering angle) has returned to center when the steering angle is equal to zero. As another example, process 400 can determine that the steering angle) has returned to center when the steering angle is within a predetermined range of zero (e.g., ±1°, ±2°, ±3°, etc.).

If process 400 determines that the steering angle has not returned to center ("NO" at 412), process 400 can return to 410, 406, and/or 402. Otherwise, if process 400 determines that the steering angle has not returned to center ("YES" at 412), process 400 can move to 414.

At 414, process 400 can cause feedback (e.g., an alert) to be provided to an operator indicating that the steering system is centered. In some embodiments, process 400 can cause any suitable type of feedback to be provided, such as non-visual feedback (e.g., feedback that an operator can feel, or feedback that an operator can hear). For example, as described above in connection with FIGS. 2, 3A and 3B, process 400 can provide haptic feedback when a steerable component (or a combination of steerable components) has returned to center (e.g., such that thrust is provided in a substantially direction that is parallel to a centerline of the vessel). As another example, as described above in connection with FIG. 2, process 400 can provide force feedback when a steerable component or steering system has returned to center (e.g., such that thrust is provided in a substantially direction that is parallel to a centerline of the vessel). As yet another example, as described above in connection with FIG. 2, process 400 can provide audio feedback (e.g., a tone or series of tones, audio content, etc.).

Additionally or alternatively, in some embodiments, process 400 can cause feedback (e.g., an alert) to be provided to an operator indicating that the steering system is approaching a centered position. For example, process 400 can cause feedback to be initiated when the steering system (and/or a steerable component thereof) is within a predetermined range (e.g., ±1°, ±2°, ±3°, etc.) of center, and can adjust the feedback (e.g., a frequency, a pattern, an intensity, a level, a type of feedback, etc.) as the steering system (and/or a steerable component thereof) moves toward the zero position. In a more particular example, as the steering angle approaches closer to zero, process 400 can increase (or decrease) a frequency and/or pattern of vibrations used to provide haptic feedback. As another more particular example, process 400 can increase (or decrease) an intensity and/or pattern of intensity of vibrations used to provide haptic feedback. As yet another more particular example, process 400 can increase (or decrease) a level of resistance (e.g., resistance to rotation of a steering wheel). In a yet more particular example, process 400 can increase resistance to rotation of a steering wheel as the steerable component(s) approaches zero and/or can decrease resistance to rotation of a steering wheel as the steerable component(s) moves away from zero, such that an operator is provided with feedback indicative of how close the steerable component is to zero. As still another more particular example, process 400 can change which type or types of feedback are being provided (e.g., haptic feedback can be provided when the steerable component approaches zero and force feedback can be provided in lieu of haptic feedback when the steerable component reaches zero, or vice versa; haptic feedback can be provided when the steerable component approaches zero and force feedback can be added when the steerable component reaches zero, or vice versa; audio feedback can be provided in addition to, or in lieu of, another type of non-visual feedback, etc.).

In some embodiments, the feedback can be provided for a predetermined amount of time (e.g., a second, a few seconds, etc.), and/or until one or more conditions are satisfied (e.g., the zero or centered position is reached, the zero or centered position is passed, etc.).

At 416, process 400 can inhibit further feedback from being provided to the operator indicative of a steering angle of the steering component(s) until one or more conditions are satisfied. For example, process 400 can inhibit feedback from being provided for a predetermined period of time. As another example, process 400 can inhibit feedback from being provided until the steering angle of the steerable component reaches a predetermined magnitude (e.g., the feedback threshold). In such an example, inhibiting the feedback from being provided can include setting or resetting a flag, signal or value (e.g., in memory and/or a component of a control circuit) to a particular value.

In some embodiments, mechanisms described herein can be used in connection with other types of vehicles that utilize a steer-by-wire system to control a steerable element (e.g., which may or may not be marine vessels) using a steering input device. In such embodiments, mechanisms described herein can be adapted to provide feedback indicative of the steerable element being centered under conditions suitable for the vehicle in which it is implemented.

Further Examples Having a Variety of Features

Implementation examples are described in the following numbered clauses:

1. A method for providing non-visual feedback when a steerable component of a marine vessel returns to center, the method comprising: determining that a rotational position of a steerable component about a steering axis has reached a centered position, wherein the steerable component is coupled to the marine vessel and configured to rotate about the steering axis to affect a direction of movement of the marine vessel; and in response to determining that the rotational position of the steerable component about the steering axis has reached the centered position, causing a feedback device to provide non-visual feedback via a steering input device to which the feedback device is coupled.
2. A method comprising: determining when a steerable component of a vehicle has returned to a centered position; and providing non-visual feedback to an operator of the vehicle upon the steerable component returning to the centered position, wherein the vehicle is optionally a marine vessel.
3. The method of clause 2, wherein the non-visual feedback is provided via a steering input device using a feedback device coupled to the steering input device.

4. The method of clauses 1 to 3, wherein the centered position corresponds to a rotational position at which the steerable component is aligned with a longitudinal axis of the marine vessel.
5. The method of clause 4, wherein the steerable component comprises a propulsion device that includes a power head, and the centered position is a rotational position at which the power head provides thrust that is directed substantially parallel to the longitudinal axis of the marine vessel.
6. The method of any one of clauses 1 and 3 to 5, wherein the steering input device comprises a steering wheel.
7. The method of any one of clauses 1 to 6, further comprising: receiving, from a steering actuator, a value indicative of the rotational position of the steerable component with respect to the centered position, wherein the steering actuator is configured to cause the steerable component to rotate about the steering axis; and determining whether the rotational position of the steerable component about the steering axis has reached the centered position based on the value.
8. The method of any one of clauses 1 and 3 to 7, wherein the feedback device comprises a motor configured to provide haptic feedback, and the non-visual feedback includes haptic feedback provided via the steering input device.
9. The method of any one of clauses 1 and 3 to 8, wherein the feedback device comprises a variable resistance device configured to apply a variable resistance force to the steering input device that resists movement of the steering input device, and the non-visual feedback includes increased resistance to steering inputs provided via the steering input device.
10. The method of any one of clauses 1 to 9, wherein determining that the steerable component has reached the centered position comprises determining that the rotational position of the steerable component is within a predetermined range of the centered position.
11. The method of any one of clauses 1 to 10, further comprising: adjusting a characteristic of the non-visual feedback as the rotational position moves closer to the centered position from a rotational position at a predetermined range from the centered position.
12. The method of any one of clauses 1 to 11, further comprising: determining that the rotational position of the steerable component is within a predetermined range of the centered position; and in response to determining that the rotational position of the steerable component is within the predetermined range of the centered position, providing a second type of non-visual feedback, wherein the non-visual feedback is a first type of non-visual feedback.
13. The method of any one of clauses 1 to 12, further comprising: determining whether one or more criteria are satisfied; and in response to determining that the one or more criteria are satisfied, determining whether the rotational position of the steerable component about the steering axis has reached the centered position.
14. The method of clause 13, wherein the one or more criteria includes at least one of the following: a speed criteria associated with a speed threshold; and a steering angle criteria associated with a steering angle threshold; and wherein the method further comprises at least one of the following: (a) comparing a speed over ground of the marine vessel to the speed threshold, and determine that the speed criteria is satisfied in response to determining that the speed over ground of the marine vessel is less than the speed threshold; or (b) comparing a steering angle of the steerable component to the steering angle threshold, and determine that the steering criteria is satisfied in response to determining that the steering angle is less than the steering angle threshold; and determining that the one or more criteria are satisfied based on: (i) the speed criteria being satisfied; (ii) the steering angle criteria being satisfied; or (iii) the speed criteria being satisfied and the steering angle criteria being satisfied.
15. The method of any one of clauses 1 to 14, further comprising: determining whether a steering angle of the steerable component has exceeded a feedback threshold angle since a last time that the steerable component was at the centered position; in response to determining that the steering angle of the steerable component has not exceeded the feedback threshold angle since the steerable component was at the centered position, inhibiting the feedback device from providing the non-visual feedback when the steerable component is centered; and in response to determining that the steering angle of the steerable component has exceeded the feedback threshold angle since the steerable component was at the centered position, causing the feedback device to provide the non-visual feedback when the steerable component has returned to center.
16. A system comprising: one or more processors configured to: perform a method of any of clauses 1 to 15.
17. A non-transitory computer-readable medium storing computer-executable code, comprising code for causing a computer to cause a processor to: perform a method of any of clauses 1 to 15.

In some embodiments, any suitable computer readable media can be used for storing instructions for performing functions and/or processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as RAM, Flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, or any suitable media that is fleeting and devoid of any semblance of permanence during transmission, and/or any suitable intangible media.

It should be noted that, as used herein, the term mechanism can encompass hardware, software, firmware, or any suitable combination thereof.

It should be understood that above-described steps of the processes of FIG. 4 can be executed or performed in any suitable order or sequence not limited to the order and sequence shown and described in the figures. Also, some of the above steps of the processes of FIG. 4 can be executed or performed substantially simultaneously where appropriate or in parallel to reduce latency and processing times.

This written description uses examples to disclose the invention(s), including the best mode, and also to enable any person skilled in the art to make and use the invention(s). Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention(s) is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for providing non-visual feedback when a steerable component of a marine vessel returns to center, the system comprising:

a steerable component coupled to the marine vessel and configured to rotate about a steering axis to affect a direction of movement of the marine vessel;

a steering input device;

a feedback device coupled to the steering input device, wherein the feedback device comprises a variable resistance device configured to apply a variable resistance force to the steering input device that resists movement of the steering input device; and one or more hardware processors configured to:

determine that a rotational position of the steerable component about the steering axis has reached a centered position; and in response to determining that the rotational position of the steerable component about the steering axis has reached the centered position, cause the feedback device to provide non-visual feedback via the steering input device, wherein the non-visual feedback includes increased resistance to steering inputs provided via the steering input device.

2. The system of claim 1, wherein the centered position corresponds to a rotational position at which the steerable component is aligned with a longitudinal axis of the marine vessel.

3. The system of claim 2, wherein the steerable component comprises a propulsion device that includes a power head, and the centered position is a rotational position at which the power head provides thrust that is directed substantially parallel to the longitudinal axis of the marine vessel.

4. The system of claim 1, wherein the steering input device comprises a steering wheel.

5. The system of claim 1, further comprising:

a steering actuator coupled to the steerable component, wherein the steering actuator is configured to cause the steerable component to rotate about the steering axis.

6. The system of claim 5, wherein the one or more hardware processors are further configured to:

receive, from the steering actuator, a value indicative of the rotational position of the steerable component with respect to the centered position; and determine whether the rotational position of the steerable component about the steering axis has reached the centered position based on the value.

7. The system of claim 1, wherein the feedback device comprises a motor configured to provide haptic feedback, and the non-visual feedback includes haptic feedback provided via the steering input device.

8. The system of claim 1, wherein the one or more hardware processors are further configured to:

determine whether the rotational position of the steerable component is within a predetermined range of the centered position; and in response to determining that the rotational position of the steerable component is within a predetermined range of the centered position, determine that the steerable component has reached the centered position.

9. The system of claim 1, wherein the one or more hardware processors are further configured to:

adjust a characteristic of the non-visual feedback as the rotational position moves closer to the centered position from a rotational position at a predetermined range from the centered position.

10. The system of claim 1, wherein the one or more hardware processors are further configured to:

determine that the rotational position of the steerable component is within a predetermined range of the centered position; and in response to determining that the rotational position of the steerable component is within the predetermined range of the centered position, provide a second type of non-visual feedback, wherein the non-visual feedback is a first type of non-visual feedback.

11. The system of claim 1, wherein the one or more hardware processors are further configured to:

determine whether one or more criteria are satisfied; and in response to determining that the one or more criteria are satisfied, determine whether the rotational position of the steerable component about the steering axis has reached the centered position.

12. The system of claim 11, wherein the one or more criteria includes at least one of the following:

a speed criteria associated with a speed threshold; and a steering angle criteria associated with a steering angle threshold; and wherein the one or more hardware processors are further configured to:

compare (a) a speed over ground of the marine vessel to the speed threshold, and determine that the speed criteria is satisfied in response to determining that the speed over ground of the marine vessel is less than the speed threshold; or (b) a steering angle of the steerable component to the steering angle threshold, and determine that the steering criteria is satisfied in response to determining that the steering angle is less than the steering angle threshold; and determine that the one or more criteria are satisfied based on:

(i) the speed criteria being satisfied;

(ii) the steering angle criteria being satisfied; or (iii) the speed criteria being satisfied and the steering angle criteria being satisfied.

13. The system of claim 1, wherein the one or more hardware processors are further configured to:

determine whether a steering angle of the steerable component has exceeded a feedback threshold angle since a last time that the steerable component was at the centered position;

in response to determining that the steering angle of the steerable component has not exceeded the feedback threshold angle since the steerable component was at the centered position, inhibit the feedback device from providing the non-visual feedback when the steerable component is centered; and in response to determining that the steering angle of the steerable component has exceeded the feedback threshold angle since the steerable component was at the centered position, cause the feedback device to provide the non-visual feedback when the steerable component has returned to center.

14. A method for providing non-visual feedback when a steerable component of a marine vessel returns to center, the method comprising:

determining that a rotational position of a steerable component about a steering axis has reached a centered position, wherein the steerable component is coupled to the marine vessel and configured to rotate about the steering axis to affect a direction of movement of the marine vessel; and in response to determining that the rotational position of the steerable component about the steering axis has reached the centered position, causing a feedback device to provide non-visual feedback via a steering input device to which the feedback device is coupled, wherein the feedback device comprises a variable resistance device configured to apply a variable resistance force to the steering input device that resists movement of the steering input device, and wherein the non-visual feedback includes increased resistance to steering inputs provided via the steering input device.

15. The method of claim 14, wherein the centered position corresponds to a rotational position at which the steerable component is aligned with a longitudinal axis of the marine vessel.

16. The method of claim 15, wherein the steerable component comprises a propulsion device that includes a power head, and the centered position is a rotational position at which the power head provides thrust that is directed substantially parallel to the longitudinal axis of the marine vessel.

17. The method of claim 14, wherein the steering input device comprises a steering wheel.

18. The method of claim 14, further comprising:

receiving, from a steering actuator, a value indicative of the rotational position of the steerable component with respect to the centered position, wherein the steering actuator is configured to cause the steerable component to rotate about the steering axis; and determining whether the rotational position of the steerable component about the steering axis has reached the centered position based on the value.

19. A system for providing non-visual feedback when a steerable component of a marine vessel returns to center, the system comprising:

a steerable component coupled to the marine vessel and configured to rotate about a steering axis to affect a direction of movement of the marine vessel;

a steering input device;

a feedback device coupled to the steering input device; and one or more hardware processors configured to:

determine whether one or more criteria are satisfied, wherein the one or more criteria includes at least one of the following:

a speed criteria associated with a speed threshold; and a steering angle criteria associated with a steering angle threshold;

compare (a) a speed over ground of the marine vessel to the speed threshold, and determine that the speed criteria is satisfied in response to determining that the speed over ground of the marine vessel is less than the speed threshold; or (b) a steering angle of the steerable component to the steering angle threshold, and determine that the steering criteria is satisfied in response to determining that the steering angle is less than the steering angle threshold;

determine that the one or more criteria are satisfied based on:

(i) the speed criteria being satisfied;

(ii) the steering angle criteria being satisfied; or (iii) the speed criteria being satisfied and the steering angle criteria being satisfied;

in response to determining that the one or more criteria are satisfied, determine whether the rotational position of the steerable component about the steering axis has reached the centered position;

determine that a rotational position of the steerable component about the steering axis has reached a centered position; and in response to determining that the rotational position of the steerable component about the steering axis has reached the centered position, cause the feedback device to provide non-visual feedback via the steering input device.

20. The system of claim 19, wherein the centered position corresponds to a rotational position at which the steerable component is aligned with a longitudinal axis of the marine vessel.

21. The system of claim 19, further comprising:

a steering actuator coupled to the steerable component, wherein the steering actuator is configured to cause the steerable component to rotate about the steering axis, and wherein the one or more hardware processors are further configured to:

receive, from the steering actuator, a value indicative of the rotational position of the steerable component with respect to the centered position; and determine whether the rotational position of the steerable component about the steering axis has reached the centered position based on the value.

22. The system of claim 19, wherein the feedback device comprises a motor configured to provide haptic feedback, and the non-visual feedback includes haptic feedback provided via the steering input device.

23. The system of claim 19, wherein the feedback device comprises a variable resistance device configured to apply a variable resistance force to the steering input device that resists movement of the steering input device, and the non-visual feedback includes increased resistance to steering inputs provided via the steering input device.

24. A method for providing non-visual feedback when a steerable component of a marine vessel returns to center, the method comprising:

determining whether one or more criteria are satisfied, wherein the one or more criteria includes at least one of the following:

a speed criteria associated with a speed threshold; and a steering angle criteria associated with a steering angle threshold;

comparing (a) a speed over ground of the marine vessel to the speed threshold, and determine that the speed criteria is satisfied in response to determining that the speed over ground of the marine vessel is less than the speed threshold; or (b) a steering angle of a steerable component to the steering angle threshold, and determine that the steering criteria is satisfied in response to determining that the steering angle is less than the steering angle threshold, wherein the steerable component is coupled to the marine vessel and configured to rotate about a steering axis to affect a direction of movement of the marine vessel;

determining that the one or more criteria are satisfied based on:

(i) the speed criteria being satisfied;

(ii) the steering angle criteria being satisfied; or (iii) the speed criteria being satisfied and the steering angle criteria being satisfied;

in response to determining that the one or more criteria are satisfied, determining whether the rotational position of the steerable component about the steering axis has reached the centered position;

determining that a rotational position of the steerable component about the steering axis has reached a centered position; and in response to determining that the rotational position of the steerable component about the steering axis has reached the centered position, causing a feedback device to provide non-visual feedback via a steering input device to which the feedback device is coupled.

25. The method of claim 24, wherein the centered position corresponds to a rotational position at which the steerable component is aligned with a longitudinal axis of the marine vessel.

26. The method of claim 24, further comprising:

receive, from a steering actuator coupled to the steerable component, a value indicative of the rotational position of the steerable component with respect to the centered position, wherein the steering actuator is configured to cause the steerable component to rotate about the steering axis, and determining whether the rotational position of the steerable component about the steering axis has reached the centered position based on the value.

27. The method of claim 24, wherein the feedback device comprises a motor configured to provide haptic feedback, and the non-visual feedback includes haptic feedback provided via the steering input device.

28. The method of claim 24, wherein the feedback device comprises a variable resistance device configured to apply a variable resistance force to the steering input device that resists movement of the steering input device, and the non-visual feedback includes increased resistance to steering inputs provided via the steering input device.

* * * * *